US010900449B2

(12) United States Patent
Shin et al.

(10) Patent No.: US 10,900,449 B2
(45) Date of Patent: Jan. 26, 2021

(54) VEHICLE SILENCER

(71) Applicant: LS MTRON LTD., Anyang-si (KR)

(72) Inventors: Jai Yoon Shin, Anyang-si (KR); Junguk Lee, Seoul (KR)

(73) Assignee: COOPERSTANDARD AUTOMOTIVE AND INDUSTRIAL INC., Gumi-si (KR)

( * ) Notice: Subject to any disclaimer, the term of this patent is extended or adjusted under 35 U.S.C. 154(b) by 425 days.

(21) Appl. No.: 15/755,979

(22) PCT Filed: May 25, 2016

(86) PCT No.: PCT/KR2016/005516

§ 371 (c)(1),
(2) Date: Feb. 27, 2018

(87) PCT Pub. No.: WO2017/039120

PCT Pub. Date: Mar. 9, 2017

(65) Prior Publication Data

US 2018/0245554 A1 Aug. 30, 2018

(30) Foreign Application Priority Data

Sep. 2, 2015 (KR) ..... 10-2015-0124160
May 19, 2016 (KR) ..... 10-2016-0061178

(51) Int. Cl.
*F02M 35/12* (2006.01)
*F01N 1/02* (2006.01)
*F01N 1/08* (2006.01)

(52) U.S. Cl.
CPC .... *F02M 35/1266* (2013.01); *F02M 35/1216* (2013.01); *F02M 35/1261* (2013.01)

(58) Field of Classification Search
CPC ..... F02M 35/12; F02M 35/1255; F02M 35/1266; F02M 35/1261; F02M 35/1216;
(Continued)

(56) References Cited

U.S. PATENT DOCUMENTS 1,070,600 A * 8/1913 Haugen ..... F01N 1/08 181/268
2,913,232 A * 11/1959 Silverman ..... B01D 47/10 261/40

(Continued)

FOREIGN PATENT DOCUMENTS

CN 102985662 A 3/2013
CN 203239431 U 10/2013

(Continued)

OTHER PUBLICATIONS

Chinese Office Action for related Chinese Application No. 201680050680.5; action dated Feb. 3, 2020; (9 pages).

(Continued)

*Primary Examiner* — Edgardo San Martin
(74) *Attorney, Agent, or Firm* — K&L Gates LLP

(57) ABSTRACT

The present invention relates to a vehicle silencer comprising: a first case provided in a vehicle; a second case coupled to the first case; a resonant chamber positioned between the first case and the second case; and a passing hole formed by penetrating the second case, such that the inside of the second case and the resonant chamber communicate with each other therethrough, wherein the second case includes a first passing member formed such that the thickness thereof gradually decreases toward a first direction.

12 Claims, 8 Drawing Sheets

(58) Field of Classification Search
CPC . F01N 1/02; F01N 1/023; F01N 1/026; F01N 1/003; F01N 1/006; F01N 1/08; F01N 1/082
See application file for complete search history.

(56) References Cited

U.S. PATENT DOCUMENTS

| | | | | |
|---|---|---|---|---|
| 5,136,923 | A * | 8/1992 | Walsh, Jr. | F41A 21/30 89/14.2 |
| 5,814,757 | A * | 9/1998 | Buss | F41A 21/36 89/14.3 |
| 6,609,592 | B2 * | 8/2003 | Wilson | B32B 3/20 181/292 |
| 6,617,002 | B2 * | 9/2003 | Wood | G10K 11/16 181/292 |
| 6,964,170 | B2 * | 11/2005 | Alkabie | F23R 3/002 60/725 |
| 7,159,692 | B1 * | 1/2007 | Frederiksen | F01N 1/08 181/227 |
| 7,934,581 | B2 * | 5/2011 | Kim | F04D 29/665 181/250 |
| 7,971,684 | B2 * | 7/2011 | Gantie | F02C 7/24 181/292 |
| 8,020,663 | B2 * | 9/2011 | Sengissen | B64C 23/005 138/41 |
| 8,640,821 | B2 * | 2/2014 | Matsushima | F01N 1/082 181/252 |
| 9,010,485 | B2 * | 4/2015 | Bornemann | F02M 35/10144 181/212 |
| 9,175,648 | B2 * | 11/2015 | Dobrin | F02M 35/1261 |
| 9,207,017 | B2 * | 12/2015 | Zaiser | B01F 5/0463 |
| 9,625,077 | B2 * | 4/2017 | Barbolini | F16L 55/033 |
| 10,386,065 | B2 * | 8/2019 | Liu | F23M 20/005 |
| 10,403,256 | B2 * | 9/2019 | Denker | F02M 35/1266 |
| 10,563,578 | B2 * | 2/2020 | Roach | B64D 33/02 |
| 2009/0014234 | A1 * | 1/2009 | Bagnall | F02C 7/045 181/214 |
| 2013/0129492 | A1 * | 5/2013 | Maas | F02C 6/12 415/182.1 |
| 2016/0054086 | A1 * | 2/2016 | Westlake | F41A 21/30 89/14.4 |

FOREIGN PATENT DOCUMENTS

| | | | |
|---|---|---|---|
| CN | 104847548 | A | 8/2015 |
| JP | H05-057308 | | 7/1993 |
| JP | 2011247104 | | 8/2011 |
| JP | 2012087797 | | 10/2012 |
| KR | 1020130117239 | A | 10/2013 |
| KR | 1020130142997 | | 12/2013 |
| WO | 2012/021361 | A1 | 2/2012 |
| WO | 2012/021361 | A2 | 2/2012 |

OTHER PUBLICATIONS

International Search Report for related International Application No. PCT/KR2016/00516; report dated Sep. 1, 2016; (3 Pages).
European Search Report for related European application No. 16842086.7; action dated Feb. 11, 2019; (6 pages).
Chinese Office Action for related Chinese Application No. 201680050680.5; action dated Jul. 3, 2019; (8 pages).

* cited by examiner

【Figure 1】
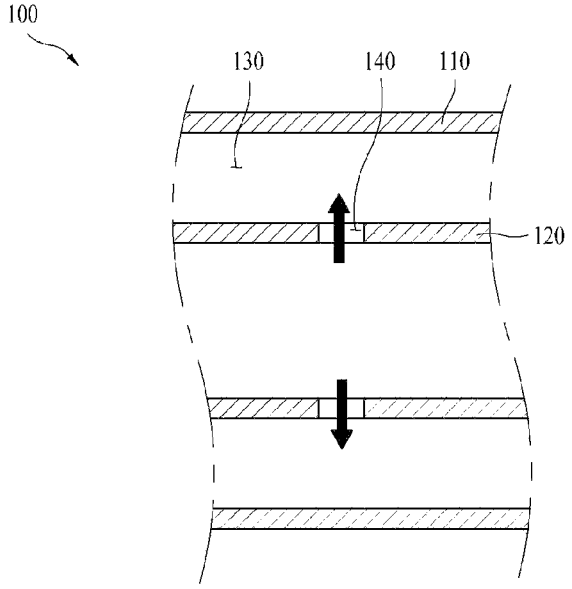
(PRIOR ART)

【Figure 2】
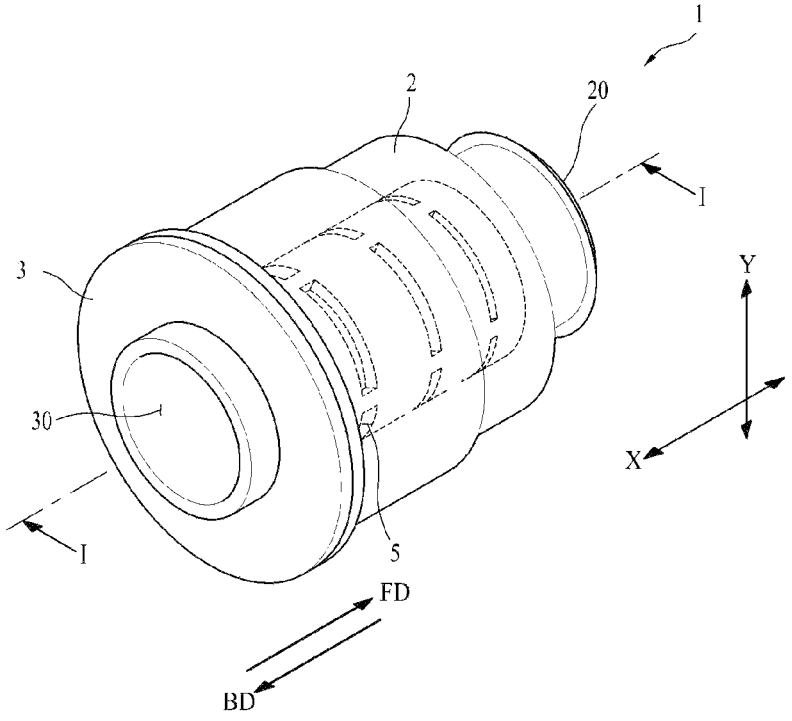

【Figure 3】
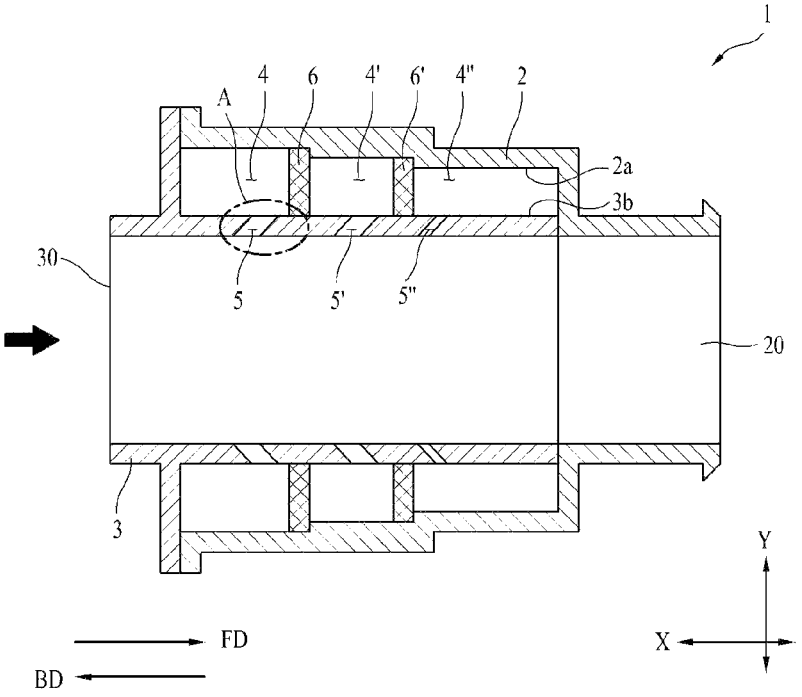
【Figure 4】
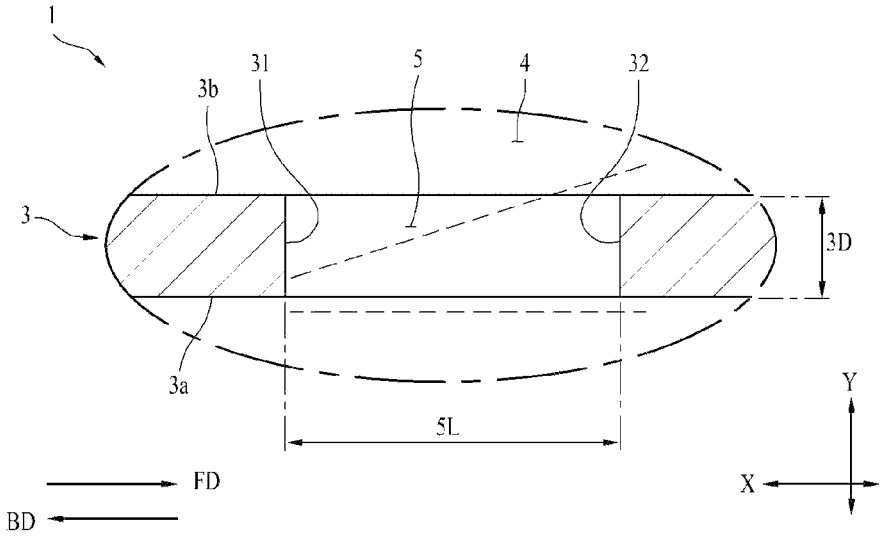

【Figure 5】
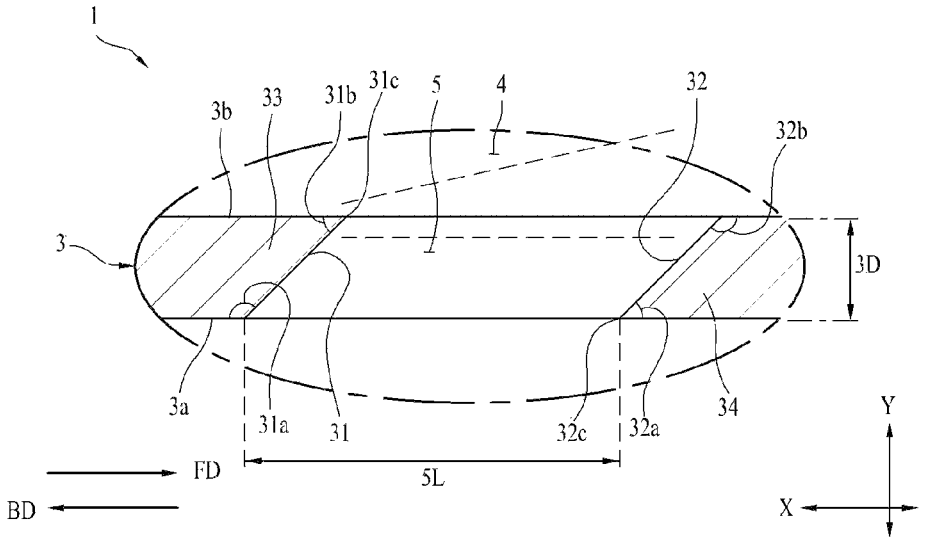
【Figure 6】
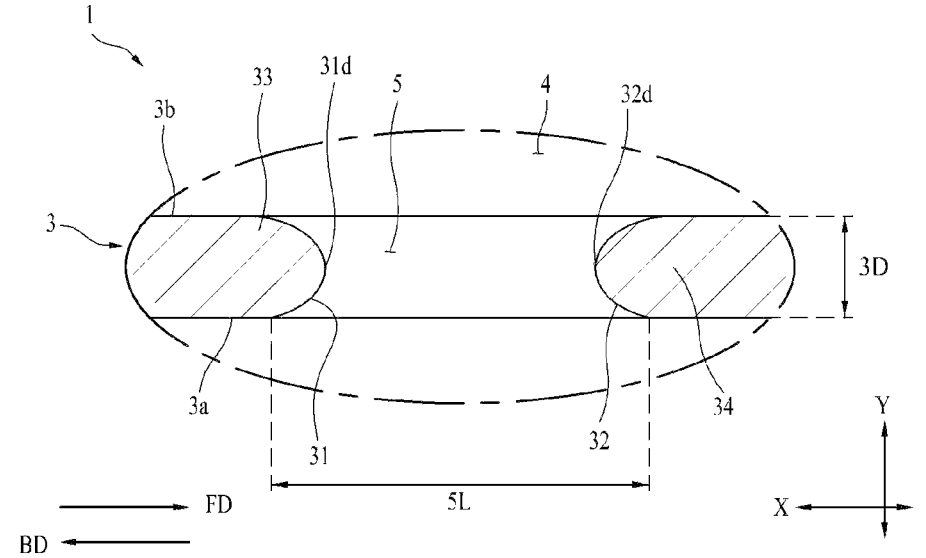

【Figure 7】
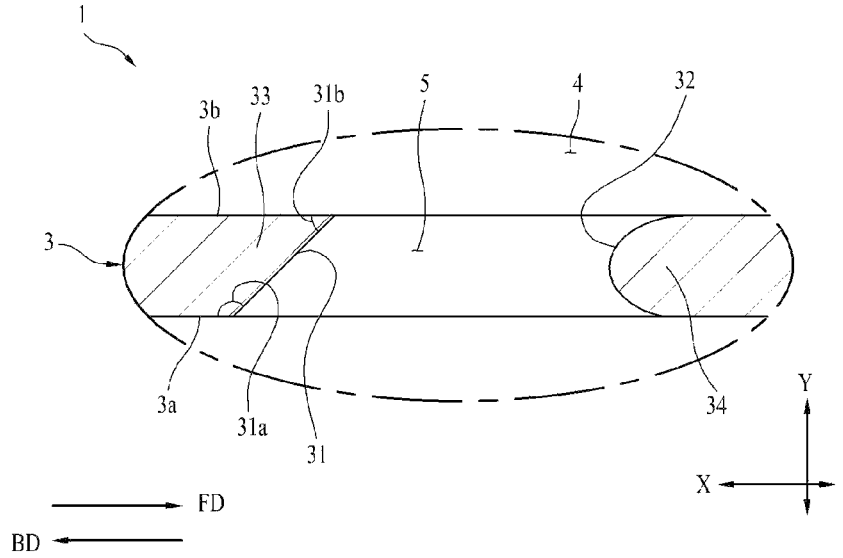
【Figure 8】
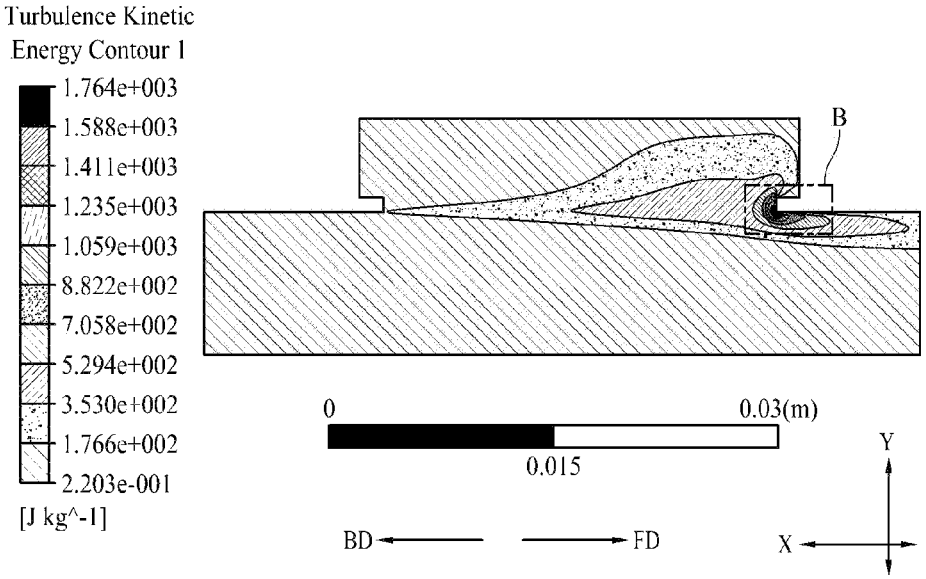

【Figure 9】
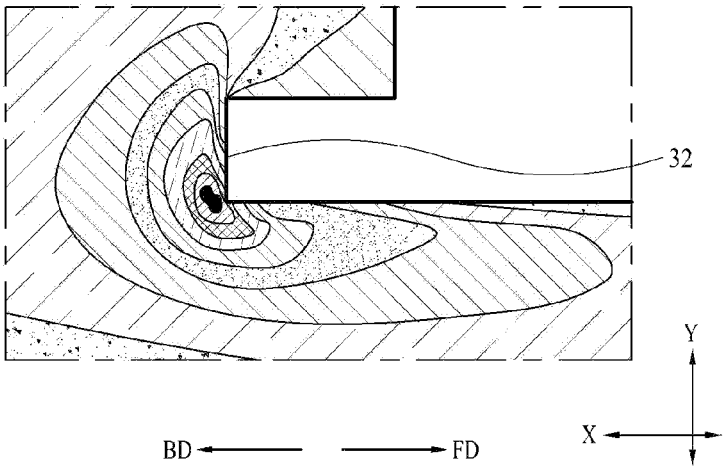
【Figure 10】
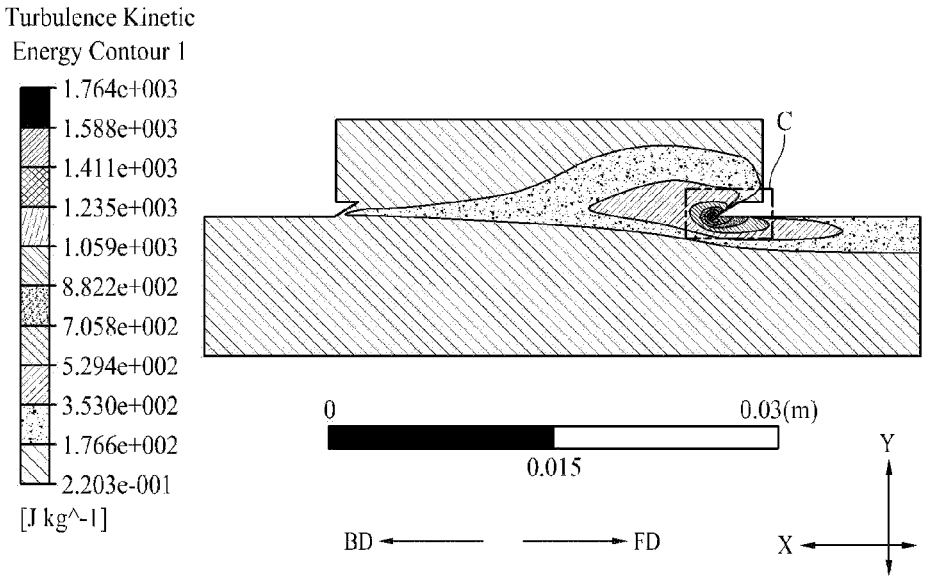

【Figure 11】
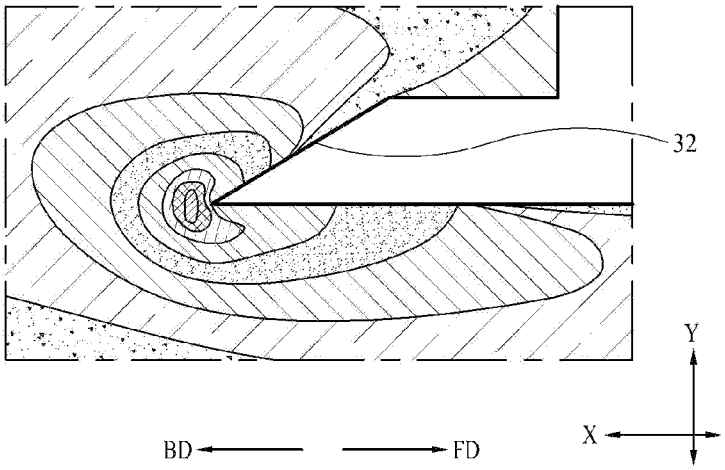
【Figure 12】
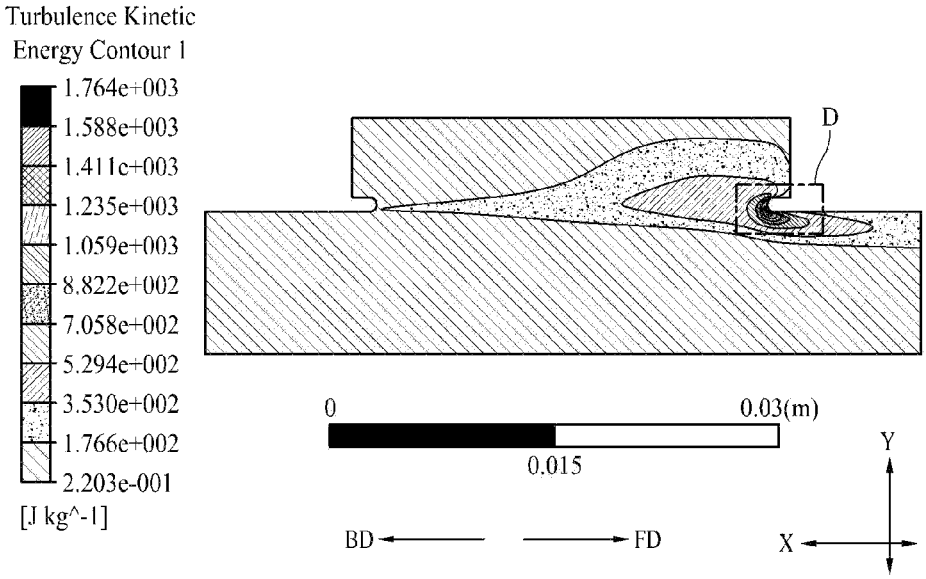

【Figure 13】
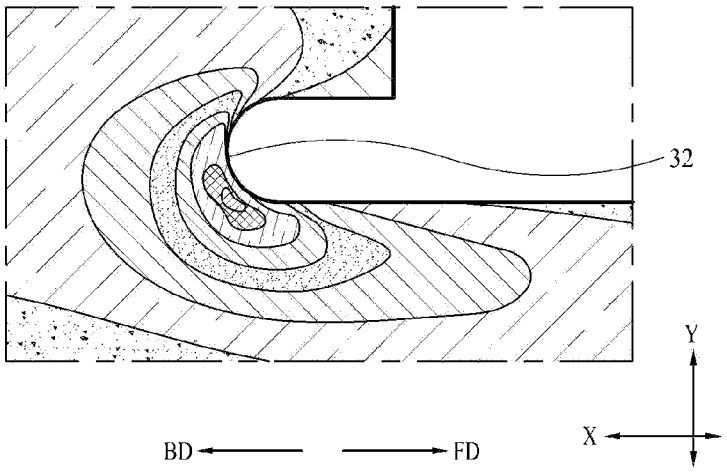

VEHICLE SILENCER

CROSS-REFERENCE TO RELATED APPLICATIONS

The present application is a National Stage of International Application No. PCT/KR2016/005516, filed May 25, 2016, which claims priority to Korean Application No. 10-2015-0124160, filed Sep. 2, 2015, and Korean Application No. 10-2016-0061178, filed May 19, 2016 the disclosures of which are incorporated herein by reference.

TECHNICAL FIELD

The present invention relates to a vehicle silencer for reducing noise generated by gases.

BACKGROUND ART

Generally, a noise is generated by gases in a vehicle. For example, gases suctioned in by an intake system of a vehicle for supplying to an internal combustion engine repeatedly expand and contract and generate a noise due to pressure change caused by pulsation of the suctioned gases. The intake system includes an air cleaner, a turbo charger, an inter cooler, an air duct, and an engine manifold.

A vehicle silencer is installed in a vehicle to reduce a noise generated by gases and is called a resonator.

FIG. 1 is a schematic cross-sectional view of a vehicle silencer according to a related art.

Referring to FIG. 1, a vehicle silencer 100 according to the related art includes a first case 110 installed in a vehicle (not shown) and a second case 120 coupled with the first case 110.

A part of the second case 120 is inserted into the first case 110. Accordingly, a resonance chamber 130 is formed between an inner surface of the first case 110 and an outer surface of the second case 120.

A through hole 140 is formed at the second case 120. The through hole 140 is formed to pass through the second case 120. Accordingly, the inside of the second case 120 is connected to the resonance chamber 130 to communicate therewith through the through hole 140. Accordingly, gases which flow along the inside of the second case 120 flow to the resonance chamber 130 through the through hole 140, and frequency is tuned in the resonance chamber 130 such that the noise is reduced.

However, in the vehicle silencer 100 according to the related art, in a process in which gases which flow to the resonance chamber 130 pass through the through hole 140, a movable shear layer is generated, grows, and collides with the second case 120 such that a turbulence pressure perturbation is caused and a turbulence noise is generated. Accordingly, the vehicle silencer 100 according to the related art has a problem in that a degree of reduction of noise generated by gases in the vehicle is decreased. Also, in the vehicle silencer 100 according to the related art, since a turbulence noise increases as a thickness of the second case 120 increases, it is difficult to increase strength of the second case 120.

DISCLOSURE

Technical Problem

The present invention is designed to solve the problems and is for providing a vehicle silencer capable of reducing a turbulence noise as well as increasing strength by increasing a thickness.

Technical Solution

To solve the above problems, the present invention may include the following configurations.

According to one aspect of the present invention, a vehicle silencer includes a first case installed in a vehicle, a second case coupled with the first case, a resonance chamber located between the first case and the second case, and a through hole formed to pass through the second case to allow an inside of the second case and the resonance chamber to communicate with each other The second case may include a first through surface located on one side of the through hole and a second through surface spaced apart from the first through surface in a first axial direction and located on the other side of the through hole. The first through surface may be formed to be an incline tilted in a second axial direction perpendicular to the first axial direction.

According to another aspect of the present invention, a vehicle silencer includes a first case installed in a vehicle, a second case coupled with the first case, a resonance chamber located between the first case and the second case, and a through hole formed to pass through the second case to allow an inside of the second case and the resonance chamber to communicate with each other. The second case may include a first through member located on one side of the through hole and a second through member spaced apart from the first through member in a first direction and located on the other side of the through hole. The first through member may be formed to have a thickness which decreases in the first direction.

Advantageous Effects

According to the present invention, following effects may be provided.

The present invention may be embodied to reduce a turbulence noise as well as to reduce a noise generated by gases using a resonance chamber so as to improve a noise reduction function.

The present invention may be embodied to increase strength by increasing a thickness as well as to reduce a turbulence noise by switching a high-strength and high-density material such as metal used in existing silencers for a low-density material such as plastic, such that it is possible to realize weight reduction and low prices with respect to a vehicle.

DESCRIPTION OF DRAWINGS

FIG. 1 is a schematic cross-sectional view of a vehicle silencer according to a related art.

FIG. 2 is a schematic perspective view of one embodiment of a vehicle silencer according to the present invention.

FIG. 3 is a schematic cross-sectional view taken along line I-I of FIG. 2.

FIG. 4 is a schematic cross-sectional view illustrating a problem which occurs when a first through surface and a second through surface are arranged perpendicular to an inner surface of a second case on the basis of part A of FIG. 3.

FIGS. 5 to 7 are enlarged schematic cross-sectional views illustrating part A of FIG. 3 in the vehicle silencer according to the present invention.

FIGS. 8 to 13 are views illustrating results of experiments in which turbulent kinetic energy was calculated and derived using flow analysis.

BEST MODE

Hereinafter, embodiments of a vehicle silencer according to the present invention will be described in detail with reference to the attached drawings.

Referring to FIGS. 2 and 3, a vehicle silencer 1 according to the present invention is installed in a vehicle (not shown) to reduce a noise generated by gases in the vehicle. For example, the vehicle silencer 1 according to the present invention may reduce a noise generated by the gases suctioned in by a turbo charger of an intake system installed in the vehicle. For this, the vehicle silencer 1 according to the present invention includes a first case 2 installed in the vehicle, a second case 3 coupled with the first case 2, a resonance chamber 4 located between the first case 2 and the second case 3, and a through hole 5 formed to pass through the second case 3.

Referring to FIGS. 2 and 3, the first case 2 is installed in the vehicle. The first case 2 is formed to be hollow to allow the second case 3 to be located therein. The first case 2 may have an overall hollow cylinder shape but is not limited thereto and may have another shape provided that the shape is capable of accommodating the second case 3 therein. A first path 20 (refer to FIG. 2) may be formed at the first case 2. The first path 20 is formed to pass through the first case 2. The gases which flow along an inside of the second case 3 may be discharged outward through the first path 20.

Referring to FIGS. 2 to 5, the second case 3 is coupled with the first case 2. A part of the second case 3 may be inserted into the first case 2 and may be coupled with the first case 2 to be located in the first case 2. The second case 3 is formed to have a hollow shape to allow the gases to flow therein. The second case 3 may have an overall hollow cylinder shape but is not limited thereto and may have another shape, provided that the shape is capable of allowing a fluid to flow therein. A second path 30 (refer to FIG. 2) may be formed at the second case 3. The second path 30 is formed to pass through the second case 3. The gases may be supplied to the inside of the second case 3 through the second path 30. In this instance, the gases supplied to the inside of the second case 3 may flow along an inner surface 3*a* (refer to FIG. 5) of the second case 3 and may be discharged through the first path 20.

Referring to FIGS. 2 to 5, the resonance chamber 4 is located between the first case 2 and the second case 3. Since the second case 3 is located in the first case 2, the resonance chamber 4 is located between an outer surface 3*b* (refer to FIG. 3) of the second case 3 and an inner surface 2*a* of the first case 2.

The resonance chamber 4 and an inside of the second case 3 communicate with each other through the through hole 5. Accordingly, the gases which flow along the inside of the second case 3 flow to the resonance chamber 4 through the through hole 5, and frequency is tuned in the resonance chamber 4 such that the noise is reduced. The resonance chamber 4 may have an overall circular ring shape but is not limited thereto and may have another shape, provided that the shape is capable of reducing a noise of the gases. The resonance chamber 4 may be formed in a variety of shapes according to a shape of the inner surface 2*a* of the first case 2 and a shape of the outer surface 3*b* of the second case 3.

Referring to FIGS. 2 to 5, the through hole 5 is formed to pass through the second case 3. The inside of the second case 3 and the resonance chamber 4 may be connected to communicate with each other through the through hole 5. The through hole 5 may be formed to have a slit shape which extends along a perimeter of the second case 3. In this instance, the through hole 5 may be formed to have a length shorter than the perimeter of the second case 3. A plurality of such through holes 5 may be formed to be spaced apart along the perimeter of the second case 3.

Here, the second case 3 may include a first through surface 31 and a second through surface 32 located so as to be spaced apart along a first axial direction (X-axis direction) by the through holes 5. The first axial direction (X-axis direction) may be an axial direction parallel to a direction in which the gases flow along the inside of the second case 3. The through hole 5 is located between the first through surface 31 and the second through surface 32 on the basis of the first axial direction (X-axis direction). The first through surface 31 is located on one side of the through hole 5. The second through surface 32 is located on the other side of the through hole 5. The first through surface 31 and the second through surface 32 may be formed along the perimeter of the second case 3. When the first through surface 31 and the second through surface 32 are formed to be a plane parallel to a second axial direction (Y-axis direction), the gases may generate a turbulence noise while passing through the through hole 5. The second axial direction (Y-axis direction) is an axial direction perpendicular to the first axial direction (X-axis direction). It will be described in detail as follows.

As shown in FIG. 4, when the gases flow along the inside of the second case 3 in a first direction FD (arrow direction) which faces the second through surface 32 from the first through surface 31, a movable shear layer is generated at the first through surface 31 and grows in the first direction FD (arrow direction). Since the first through surface 31 and the inner surface 3*a* of the second case 3 are arranged to be perpendicular to each other, the movable shear layer, shown as a dotted line in FIG. 4, is generated and grows from a point at which the first through surface 31 and the inner surface of the second case 3 are connected to each other. The movable shear layer which grows as described above collides with the second through surface 32 such that strong turbulence pressure perturbation is caused and a turbulent noise is generated. Since the second through surface 32 and the inner surface 3*a* of the second case 3 are arranged to be perpendicular to each other, the second through surface 32 includes a wide area capable of colliding with the movable shear layer.

The turbulent noise increases in proportion to a length 5L of the through hole 5 in the first direction FD (arrow direction). This is because the movable shear layer grows larger as the length 5L of the through hole 5 increases in the first direction FD (arrow direction). Also, the turbulence noise increases in proportion to a thickness 3D of the second case 3. This is because the turbulence pressure perturbation caused by the collision between the movable shear layer and the second through surface 32 increases as the thickness 3D of the second case 3 increases.

As described above, when at least one of the first through surface 31 and the second through surface 32 is configured to form a plane parallel to the second axial direction (Y-axis direction) and is disposed to be perpendicular to the inner surface 3*a* of the second case 3, a degree of reduction of noise generated by the gases in the vehicle may be decreased by the turbulence noise. Also, since the turbulent noise increases as the thickness 3D of the second case 3 increases, when the second case 3 is manufactured using plastic, which has less strength than that of a metal, it is difficult to increase the strength of the second case 3. Meanwhile, although not shown in the drawing, when the gases flow along the inside of the second case 3 in a second direction BD (arrow direction) opposite the first direction FD (arrow direction), the turbulent noise may occur as the movable shear layer, which is generated at the point at which the second through surface 32 and the inner surface 3*a* of the second case 3 are connected, grows along the second direction BD (arrow direction) and then collides with the first through surface 31.

To remedy this, in the vehicle silencer 1 according to the present invention, the second case 3 may be embodied in a variety of embodiments. Hereinafter, the embodiments of the second case 3 will be sequentially described with reference to the attached drawings.

First Embodiment

Referring to FIG. 5, in the second case 3 according to a first embodiment, the first through surface 31 is formed as an incline tilted on the basis of the second axial direction (Y-axis direction). Accordingly, the first through surface 31 is not disposed in a direction perpendicular to the inner surface 3*a* of the second case 3. Accordingly, when gases flow along the inside of the second case 3 in the first direction FD (arrow direction), the vehicle silencer 1 according to the present invention may reduce generation of a movable shear layer at the point at which the first through surface 31 and the inner surface 3*a* of the second case 3 are connected to each other. Although not shown in the drawings, when the gases flow along the inside of the second case 3 in the second direction BD (arrow direction), the vehicle silencer 1 according to the present invention may reduce an area of the first through surface 31, with which the movable shear layer may collide. Accordingly, the vehicle silencer 1 according to the present invention may provide the following effects.

First, the vehicle silencer 1 according the present invention is embodied to reduce, using the resonance chamber 4, a noise generated by gases as well as reduce a turbulence noise which occurs during a process in which the gases pass through the through hole 5. Accordingly, the vehicle silencer 1 according to the present invention may improve a noise reduction function.

Second, since the vehicle silencer 1 according to the embodiment is capable of reducing a turbulence noise, strength of the second case 3 may be increased by increasing the thickness of the second case 3. Accordingly, the vehicle silencer 1 according to the present invention may be embodied to allow the second case 3 to have adequate strength by increasing the thickness of the second case 3 even when the second case 3 is formed of a plastic with strength lower than that of a metal. Accordingly, the vehicle silencer 1 according to the present invention may realize weight reduction and low prices with respect to a vehicle by forming the second case 3 using plastic. In the vehicle silencer 1 according to the present invention, both the second case 3 and the first case 2 may be formed of plastic.

When the gases flow in the first direction FD (arrow direction) in the second case 3, the first through surface 31 may be formed to be an incline with an obtuse included angle 31*a* between the first through surface 31 and the inner surface 3*a* of the second case 3. Accordingly, the vehicle silencer 1 according to the present invention may be embodied to allow a movable shear layer to be generated at a point spaced apart from the point at which the first through surface 31 and the inner surface 3*a* of the second case 3 are connected. Accordingly, as a dot line shown in FIG. 5, the vehicle silencer 1 according to the present invention may reduce an area in which the movable shear layer may collide with the second through surface 32 by adjusting a growth direction in which the movable shear layer grows in the first direction FD (arrow direction). Accordingly, since the vehicle silencer 1 according to the present invention may reduce a turbulence noise as well as increase strength of the second case 3 by increasing the thickness of the second case 3, the noise reduction function may be further improved, and weight reduction and low prices with respect to a vehicle may be realized using a lightweight and low-priced material such as plastic and the like. In this instance, the first through surface 31 may be formed to be an incline with an acute included angle 31*b* between the first through surface 31 and the outer surface 3*b* of the second case 3.

Referring to FIG. 5, in the second case 3 according to the first embodiment, the second through surface 32 is formed as an incline tilted on the basis of the second axial direction (Y-axis direction). Accordingly, the second through surface 32 is not disposed in a direction perpendicular to the inner surface 3*a* of the second case 3. Accordingly, when the gases flow along the inside of the second case 3 in the first direction FD (arrow direction), the vehicle silencer 1 according to the present invention may reduce an area of the second through surface 32 with which the movable shear layer may collide. Although not shown in the drawing, when gases flow along the inside of the second case 3 in the second direction BD (arrow direction), the vehicle silencer 1 according to the present invention may reduce generation of the movable shear layer at the point at which the second through surface 32 and the inner surface 3*a* of the second case 3 are connected to each other. Accordingly, the vehicle silencer 1 according to the present invention may improve the noise reduction function as well as realize weight reduction and low prices with respect to a vehicle by using a lightweight and low-priced material such as plastic and the like.

When the gases flow in the first direction FD (arrow direction) in the second case 3, the second through surface 32 may be formed to be an incline with an acute included angle 32*a* between the second through surface 32 and the inner surface 3*a* of the second case 3 and with an obtuse included angle 32*b* between the second through surface 32 and the outer surface 3*b* of the second case 3. Accordingly, the vehicle silencer 1 according to the present invention may reduce an area of the second through surface 32 with which the movable shear layer which grows in the first direction FD (arrow direction) may collide, and may reduce a level of perturbation caused by turbulent flow and generated as the movable shear layer which grows in the first direction FD (arrow direction) collides with the second through surface 32. Accordingly, since the vehicle silencer 1 according to the present invention may reduce a turbulence noise as well as increase strength of the second case 3 by increasing the thickness of the second case 3, the noise reduction function may be further improved, and weight reduction and low prices with respect to a vehicle may be realized using a lightweight and low-priced material such as plastic and the like.

In the second case 3 according to the first embodiment, any one of the first through surface 31 and the second through surface 32 may be formed to be an incline. Both the first through surface 31 and the second through surface 32 may be formed to be inclines. In this instance, when gases flow in the first direction FD (arrow direction), the second case 3 according to the first embodiment may be embodied to allow the included angle 31*a* between the first through surface 31 and the inner surface 3*a* of the second case 3 to be an obtuse angle, to allow the included angle 32*a* between the second through surface 32 and the inner surface 3*a* of the second case 3 to be an acute angle, and to allow the included angle 32*b* between the second through surface 32 and the outer surface 3*b* of the second case 3 to be an obtuse angle. In this instance, the included angle 31*b* between the first through surface 31 and the outer surface 3*b* of the second case 3 may be embodied to be an acute angle.

The second case 3 according to the first embodiment may include a first through member 33 located on one side of the through hole 5 and a second through member 34 spaced in the first direction FD (arrow direction) apart from the first through member 33 and located on the other side of the through hole 5.

The first through member 33 is formed to have a thickness which decreases in the first direction FD (arrow direction). Accordingly, one surface of the first through member 33 is not disposed in a direction perpendicular to the inner surface 3*a* of the second case 3. The one surface of the first through member 33 is a surface of the first through member 33, which faces the second through member 34, and may correspond to the first through surface 31.

The first through member 33 may be formed to be an incline protruding by a maximum length in the first direction FD (arrow direction) from a point 31*c* (refer to FIG. 5) connected to the outer surface 3*b* of the second case 3. In this instance, the gases may flow in the first direction FD (arrow direction) in the second case 3. Accordingly, the vehicle silencer 1 according to the present invention may be embodied to allow the movable shear layer to be generated at a point spaced apart from a point at which the one surface of the first through member 33 and the inner surface 3*a* of the second case 3 are connected. Accordingly, as shown with the dotted line in FIG. 5, the vehicle silencer 1 according to the present invention may reduce an area in which the movable shear layer may collide with the second through member 34 by adjusting a growth direction in which the movable shear layer grows in the first direction FD (arrow direction). Accordingly, since the vehicle silencer 1 according to the present invention may reduce a turbulence noise as well as increase strength of the second case 3 by increasing the thickness of the second case 3, the noise reduction function may be further improved, and weight reduction and low prices with respect to a vehicle may be realized using a lightweight material and low-priced material such as plastic and the like. When the first through surface 31 is formed at the first through member 33, the point 31*c* at which the first through member 33 is connected to the outer surface 3*b* of the second case 3 is a point at which the first through surface 31 is connected to the outer surface 3*b* of the second case 3.

The second through member 34 is formed to have a thickness which decreases in the second direction BD (arrow direction). Accordingly, one surface of the second through member 34 is not disposed in a direction perpendicular to the inner surface 3*a* of the second case 3. The one surface of the second through member 34 is a surface of the second through member 34, which faces the first through member 33, and may correspond to the second through surface 32.

The second through member 34 may be formed to be an incline protruding by a maximum length in the second direction BD (arrow direction) from a point 32*c* (refer to FIG. 5) connected to the inner surface 3*a* of the second case 3. In this instance, the gases may flow in the first direction FD (arrow direction) in the second case 3. Accordingly, the vehicle silencer 1 according to the present invention may reduce an area of the second through member 34, with which the movable shear layer which grows in the first direction FD (arrow direction) may collide, and may reduce a level of perturbation caused by turbulent flow and generated as the movable shear layer which grows in the first direction FD (arrow direction) collides with the second through member 34. Accordingly, since the vehicle silencer 1 according to the present invention may reduce a turbulence noise as well as increase strength of the second case 3 by increasing the thickness of the second case 3, the noise reduction function may be further improved, and weight reduction and low prices with respect to a vehicle may be realized using a lightweight material and low-priced material such as plastic and the like. When the second through surface 32 is formed at the second through member 34, the point 32*c* at which the second through member 34 is connected to the inner surface 3*a* of the second case 3 is a point at which the second through surface 32 is connected to the inner surface 3*a* of the second case 3.

The second case 3 according to the first embodiment may be formed to allow a value obtained by dividing the length 5L of the through hole 5 in the first axial direction (X-axis direction) by the thickness 3D of the second case 3 in the second axial direction (Y-axis direction) to be greater than 2. When the value obtained by dividing the length 5L of the through hole 5 by the thickness 3D of the second case 3 is smaller than 2, since the length 5L of the through hole 5 is then embodied to be too short to allow the movable shear layer to adequately grow, an area of the second through surface 32 with which the movable shear layer collides increases. Accordingly, a degree of reduction with respect to a noise generated by gases in the vehicle, caused by the occurrence of a turbulence noise, may be decreased. On the other hand, when the value obtained by dividing the length 5L of the through hole 5 by the thickness 3D of the second case 3 is greater than 2, since the length 5L of the through hole 5 is embodied to be long enough to allow the movable shear layer to adequately grow, an area of the second through surface 32 with which the movable shear layer collides decreases. Accordingly, a degree of reduction with respect to a noise generated by gases in the vehicle, caused by the occurrence of a turbulence noise, may be increased.

Second Embodiment

Referring to FIG. 6, the second case 3 according to a second embodiment includes the first through member 33 and the second through member 34. Since the first through member 33 and the second through member 34 are approximately identical to that in the above description with respect to the second case 3 according to the first embodiment, only differing parts will be described.

The first through member 33 may be formed between the inner surface 3*a* of the second case 3 and the outer surface 3*b* of the second case 3 to protrude by a maximum length in the first direction FD (arrow direction). Accordingly, a point 31*d* which protrudes by a maximum length from the first through member 33 in the first direction FD (arrow direction) may be located at a position spaced apart from the inner surface 3*a* of the second case 3 and the outer surface 3*b* of the second case 3 on the basis of the second axial direction (Y-axis direction). In this instance, the vehicle silencer 1 according to the present invention may be embodied to allow a movable shear layer to be formed, when gases flow in the first direction FD (arrow direction) in the second case 3, at a point spaced apart from the point at which one surface of the first through member 33 and the inner surface 3*a* of the second case 3 are connected to each other. Accordingly, shown with the dotted line in FIG. 5, the vehicle silencer 1 according to the present invention may reduce an area in which the movable shear layer may collide with the second through member 34 by adjusting a growth direction in which the movable shear layer grows in the first direction FD (arrow direction). Accordingly, since the vehicle silencer 1 according to the present invention may reduce a turbulence noise as well as increase strength of the second case 3 by increasing the thickness of the second case 3, the noise reduction function may be further increased, and weight reduction and low prices with respect to a vehicle may be realized using a lightweight material and low-priced material such as plastic and the like. The point 31*d* at which a maximum length of protrusion of the first through member 33 in the first direction FD (arrow direction) occurs may be located at a position spaced apart from the inner surface 3*a* of the second case 3 and the outer surface 3*b* of the second case 3 by the same distance in the second axial direction (Y-axis direction).

The first through surface 31 is formed at the first through member 33. The first through surface 31 corresponds to one surface of the first through member 33. In this instance, the point 31*d* at which a maximum length of protrusion of the first through member 33 in the first direction FD (arrow direction) occurs is a point of a maximum length of protrusion of the first through surface 31 in the first direction FD (arrow direction). The first through surface 31 may be formed to be an incline or a curved surface.

When the first through surface 31 is formed to be a curved surface, as shown in FIG. 6, a cross section of the first through surface 31 is embodied to form a semi-elliptical shape on the basis of the second axial direction (Y-axis direction) such that the first through member 33 may be formed to protrude by a maximum length between the inner surface 3*a* of the second case 3 and the outer surface 3*b* of the second case 3 in the first direction FD (arrow direction). The first through member 33 may be embodied to allow the cross section of the first through surface 31 to form a semicircular shape on the basis of the second axial direction (Y-axis direction).

Although not shown in the drawing, when the first through surface 31 is formed to be an incline, the cross section of the first through surface 31 on the basis of the second axial direction (Y-axis direction) is embodied to form a triangular shape such that the first through member 33 may be formed to protrude by a maximum length in the first direction FD (arrow direction) between the inner surface 3*a* of the second case 3 and the outer surface 3*b* of the second case 3.

The second through member 34 may be formed between the inner surface 3*a* of the second case 3 and the outer surface 3*b* of the second case 3 to protrude by a maximum length in the second direction BD (arrow direction). Accordingly, a point 32*d* at which a maximum length of protrusion of the second through member 34 in the second direction BD (arrow direction) occurs may be located at a position spaced apart from the inner surface 3*a* of the second case 3 and the outer surface 3*b* of the second case 3 in the second axial direction (Y-axis direction). In this instance, when the gases flow in the first direction FD (arrow direction) in the second case 3, the vehicle silencer 1 according to the present invention may reduce an area of the second through member 34 with which the movable shear layer growing in the first direction FD (arrow) collides, and may reduce a level turbulence pressure flow perturbation which occurs as the movable shear layer growing in the first direction FD (arrow direction) collides with the second through member 34. Accordingly, since the vehicle silencer 1 according to the present invention may reduce a turbulence noise as well as increase strength of the second case 3 by increasing the thickness of the second case 3, the noise reduction function may be further improved, and weight reduction and low prices with respect to a vehicle may be realized using a lightweight material and low-priced material such as plastic and the like. The point 32*d* at which a maximum length of protrusion of the second through member 34 in the second direction BD (arrow direction) may be located at a position spaced apart from the inner surface 3*a* of the second case 3 and the outer surface 3*b* of the second case 3 by the same distance in the second axial direction (Y-axis direction).

The second through surface 32 may be formed at the second through member 34. The second through surface 32 corresponds to one surface of the second through member 34. In this instance, the point 32*d* at which the maximum length of protrusion of the second through member 34 in the second direction BD (arrow direction) occurs is a point of a maximum length of protrusion of the second through surface 32 in the second direction BD (arrow direction). The second through surface 32 may be formed to be an incline or a curved surface.

When the second through surface 32 is formed to be a curved surface, as shown in FIG. 6, a cross section of the second through surface 32 is embodied to form a semi-elliptical shape on the basis of the second axial direction (Y-axis direction) such that the second through member 34 may be formed to protrude by a maximum length in the second direction BD (arrow direction) between the inner surface 3*a* of the second case 3 and the outer surface 3*b* of the second case 3. The second through member 34 may be embodied to allow the cross section of the second through surface 32 to form a semicircular shape on the basis of the second axial direction (Y-axis direction).

Although not shown in the drawing, when the second through surface 32 is formed to be an incline, the cross section of the second through surface 32 is embodied to form a triangular shape on the basis of the second axial direction (Y-axis direction) such that the second through member 34 may be formed to protrude by a maximum length in the second direction BD (arrow direction) between the inner surface 3*a* of the second case 3 and the outer surface 3*b* of the second case 3.

As described above, in the vehicle silencer 1 according to the present invention, the second case 3 may be embodied in a variety of embodiments. Although the first through surface 31 and the second through surface 32 are formed in shapes corresponding to each other in FIGS. 5 and 6, the first through surface 31 and the second through surface 32 are not limited thereto and may be formed in different shapes.

For example, as shown in FIG. 7, the second case 3 may be embodied through a combination of the first through surface 31 being formed to be the incline as described with respect to the first embodiment and the second through surface 32 being formed to have a shape of any one of the semi-elliptical cross section and the semicircular cross section as described with respect to the second embodiment.

Although not shown in the drawings, the second case 3 may be embodied through a combination of the first through surface 31 being formed to have a shape of any one of the semi-elliptical cross section, the semicircular cross section, and the triangular cross section as described with respect to the second embodiment and the second through surface 32 being formed to be the incline as described with respect to the first embodiment. In this instance, the second case 3 may be formed to have a shape which allows the first through member 33 to decrease in thickness in the first direction FD (arrow direction) and allows the second through member 34 to decrease in thickness in the second direction BD (arrow direction).

As described above, the vehicle silencer 1 according to the present invention is embodied to include the second case 3 according to the first embodiment and the second case 3 according to the second embodiment so as to improve the noise reduction function by reducing a turbulence noise as well as to realize weight reduction and low prices of a vehicle by switching a high-strength and high-density material such as metal used in existing silencers for a low-density material such as plastic.

This may be seen from results of experiments calculating and deriving turbulence kinetic energy from flow analysis with respect to a comparative example in which the first through surface 31 and the second through surface 32 are arranged in a direction perpendicular to the inner surface 3*a* of the second case 3 as shown in FIG. 4, to the first embodiment in which the first through surface 31 and the second through surface 32 are formed to be inclines tilted on the basis of the second axial direction (Y-axis direction) as shown in FIG. 5, and to the second embodiment in which the first through surface 31 and the second through surface 32 are formed to be curved surfaces as shown in FIG. 6. Description will be made in detail as follows with reference to FIGS. 4 to 13.

First, in the results of experiments shown in FIGS. 8 to 13, numbers arranged on a left side in a longitudinal direction refer to levels of turbulence kinetic energy, and symbols arranged to the left of the corresponding numbers in a longitudinal direction show turbulence kinetic energy levels classified in certain ranges. The numbers and symbols arranged in upper parts have higher levels of turbulence kinetic energy.

Next, FIGS. 8 and 9 illustrate results of experiments with respect to the comparative example as shown in FIG. 4, and FIG. 9 is an enlarged view illustrating a part B of FIG. 8. The part B of FIG. 8 is an area which includes a region in which the second through surface 32 is formed in FIG. 4. As known from FIGS. 8 and 9, in the comparative example, a range of levels of turbulence kinetic energy around the second through surface 32 is 1.588e+003 to 1.764+003, in which a symbol corresponding to a maximum value is shown, as well as symbols with a broad range of turbulence kinetic energy levels across a considerably broad area around the second through surface 32.

Next, FIGS. 10 and 11 illustrate results of experiments with respect to the first embodiment as shown in FIG. 5, and FIG. 11 is an enlarged view illustrating a part C of FIG. 10. The part C of FIG. 10 is an area which includes a region in which the second through surface 32 is formed in FIG. 5. As known from FIGS. 10 and 11, unlike in the comparative example, in the first embodiment, a range of turbulence kinetic energy levels around the second through surface 32 is 1.588e+003 to 1.764+003, and a symbol corresponding to a maximum value is not shown. Accordingly, in comparison to the comparative example, since the first embodiment may reduce the turbulence kinetic energy around the second through surface 32, it may be known that it is possible to further reduce a turbulence noise. Also, the range of the turbulence kinetic energy levels is 1.766e+002 to 3.530e+002, and unlike the comparative example in which a symbol is shown in an area which deviates from the second through surface 32 as shown in FIG. 9, a symbol which belongs to a range of relatively low levels is shown in an area in which the second through surface 32 is located in the first embodiment as shown in FIG. 11. Accordingly, in comparison to the comparative example, since the first embodiment may decrease a level of the turbulence kinetic energy in the region in which the second through surface 32 is located, it may be known that it is possible to further reduce a turbulence noise.

Next, FIGS. 12 and 13 illustrate results of experiments with respect to the second embodiment as shown in FIG. 6, and FIG. 13 is an enlarged view illustrating a part D of FIG. 12. The part D of FIG. 12 is an area which includes a region in which the second through surface 32 is formed in FIG. 6. As known from FIGS. 12 and 13, unlike in the comparative example, in the second embodiment, a range of turbulence kinetic energy levels around the second through surface 32 is 1.588e+003 to 1.764+003, and a symbol corresponding to a maximum value is not shown. Accordingly, in comparison to the comparative example, since the second embodiment may reduce the turbulence kinetic energy around the second through surface 32, it may be known that it is possible to further reduce a turbulence noise. Also, in the second embodiment, in comparison to the comparative example, since symbols which belong to a range of turbulence kinetic energy levels higher than 5.294e+002 occupy a smaller area on the basis of the first axial direction (X-axis direction) and the second axial direction (Y-axis direction), it may be known that it is possible to further reduce a turbulence noise.

Referring to FIG. 3, the vehicle silencer 1 according to the present invention may include a division member 6.

The division member 6 is located between the inner surface 2*a* of the first case 2 and the outer surface 3*b* of the second case 3. The division member 6 divides a gap between the inner surface 2*a* of the first case 2 and the outer surface 3*b* of the second case 3 into a plurality of spaces. Accordingly, the vehicle silencer 1 according to the present invention may be embodied to include a plurality of resonance chambers 4, 4', and 4". In this instance, the vehicle silencer 1 according to the present invention may be embodied to include a plurality of through holes 5, 5', and 5" which connect the resonance chambers 4, 4', and 4" to the inside of the second case 3.

Accordingly, since the vehicle silencer 1 according to the present invention is embodied to smoothly tune both gases in a bandwidth with a high frequency and gases in a bandwidth with a low frequency by using the plurality of resonance chambers 4, 4', and 4", a frequency noise across a wide band may be reduced. Accordingly, the vehicle silencer 1 according to the present invention may further improve a noise reduction function. In this instance, the resonance chambers 4, 4', and 4" may have different sizes. The through holes 5, 5', and 5" may have different sizes. The above-described variety of embodiments of the second case 3 may be applied to regions in which the through holes 5, 5', and 5" are formed.

Although it is shown in FIG. 3 that the vehicle silencer 1 according to the present invention includes two division members 6 and 6' and accordingly includes the three resonance chambers 4 and the three through holes 5, the vehicle silencer 1 according to the present invention is not limited thereto and may be embodied to include one or three or more division members 6 and accordingly include two or four or more resonance chambers 4 and through holes 5.

The division member 6 may have an overall circular ring shape but is not limited thereto and may have another shape, provided that the shape is capable of dividing the resonance chamber 4 into a plurality of sections. The division member 6 may be formed to be integrated with the second case 3.

The present invention is not limited to the above-described embodiments and the attached drawings, and it will be understood by one of ordinary skill in the art that a variety of substations, modifications, and changes may be made therein without departing from the technical concept of the invention.

The invention claimed is:

1. A vehicle silencer comprising:

a first case installed in a vehicle;

a second case coupled with the first case;

a resonance chamber located between the first case and the second case; and a through hole formed to pass through the second case to allow an inside of the second case and the resonance chamber to communicate with each other, wherein the second case comprises a first through member located on one side of the through hole and a second through member spaced apart from the first through member in a first direction and located on the other side of the through hole, wherein a first through surface which faces the second through member is formed at the first through member, a second through surface which faces the first through member is formed at the second through member, whereby the through hole is located between the first through surface and the second through surface, wherein the through hole is formed to have a slit shape which extends along a perimeter of the second case, wherein the second case is formed to allow a value obtained by dividing a length of the through hole in the first direction by a thickness of the second case in an axial direction perpendicular to the first direction, to be greater than 2, wherein the first through surface is formed to protrude in the first direction between an inner surface of the second case and an outer surface of the second case, wherein the second through surface is formed to protrude in a second direction opposite the first direction between an inner surface of the second case and an outer surface of the second case.

2. The vehicle silencer of claim 1, wherein the first through surface is formed to be a curved surface.

3. The vehicle silencer of claim 1, wherein the second case is formed of plastic.

4. The vehicle silencer of claim 1, wherein the first through surface is formed such that a point at which a maximum length of protrusion in the first direction occurs is located at a position spaced apart from the inner surface of the second case and the outer surface of the second case by the same distance.

5. The vehicle silencer of claim 1, wherein the first through surface is formed to protrude by a maximum length in the first direction between an inner surface of the second case and an outer surface of the second case.

6. The vehicle silencer of claim 1, wherein gases flow in the first direction in the second case, and wherein the first through surface is formed to be an incline at a point connected to the outer surface of the second case and to protrude by the maximum length in the first direction.

7. The vehicle silencer of claim 1, wherein the second through surface is formed to be a curved surface.

8. The vehicle silencer of claim 1, wherein the second through surface is formed such that a point at which a maximum length of protrusion in the second direction occurs is located at a position spaced apart from the inner surface of the second case and the outer surface of the second case by the same distance.

9. The vehicle silencer of claim 1, wherein the second through surface is formed to protrude by a maximum length in the second direction between an inner surface of the second case and an outer surface of the second case.

10. The vehicle silencer of claim 1, wherein gases flow in the first direction in the second case, and wherein the second through surface is formed to be an incline at a point connected to the inner surface of the second case and to protrude by a maximum length in the second direction.

11. The vehicle silencer of claim 1, wherein gases flow in the first direction in the second case, wherein the first through surface is formed at the first through member to be tilted to form an obtuse included angle between the first through member and an inner surface of the second case, and wherein the second through surface is formed at the second through member to be tilted to form an acute included angle between the second through member and the inner surface of the second case.

12. The vehicle silencer of claim 1, wherein the first through surface is formed to have a cross section of a semi-elliptical shape or a semicircular shape, and wherein the second through surface is formed to have a cross section of a semi-elliptical shape or a semicircular shape.

* * * * *